US006224229B1

(12) United States Patent
Lin

(10) Patent No.: US 6,224,229 B1
(45) Date of Patent: May 1, 2001

(54) ROTATABLE DRIVING TOOL HAVING LIGHT DEVICE

(76) Inventor: Ching Chou Lin, No. 150, Sec. 3, Chung San Road, Wu Zh Hsiang, Taichung Hsien (TW)

( * ) Notice: Subject to any disclaimer, the term of this patent is extended or adjusted under 35 U.S.C. 154(b) by 0 days.

(21) Appl. No.: 09/376,417

(22) Filed: Aug. 18, 1999

(51) Int. Cl.[7] ..... B25B 23/18
(52) U.S. Cl. ..... 362/119; 362/427; 362/197
(58) Field of Search ..... 362/119, 109, 362/191, 190, 287, 427, 269, 197, 198, 199, 120, 394, 395; 81/29, 58.3

(56) References Cited

U.S. PATENT DOCUMENTS 2,292,228 * 8/1942 Krieger ..... 81/29
5,558,430 * 9/1996 Booty ..... 362/184
5,713,656 2/1998 Lin ..... 362/120
5,782,146 * 7/1998 Lin ..... 81/58.3
5,875,692 3/1999 Lin ..... 81/58.3

* cited by examiner

*Primary Examiner*—Sandra O'Shea
*Assistant Examiner*—Hargobind S. Sawhney
(74) *Attorney, Agent, or Firm*—Charles E. Baxley

(57) ABSTRACT

A tool includes one or more batteries received in a handle, and one or more light bulbs secured on a housing. The housing is pivotally coupled to the handle and an electric coupling couples the batteries to the light bulbs and to energize the light bulbs when the housing is rotated relative to the handle. Two conductors are coupled to the light bulbs, and two further conductors couple the batteries to the light bulbs via the conductors of ring-shaped. A ratchet mechanism is disposed in the housing for controlling the driving direction of a driving stem.

9 Claims, 6 Drawing Sheets

ROTATABLE DRIVING TOOL HAVING LIGHT DEVICE

BACKGROUND OF THE INVENTION

1. Field of the Invention

The present invention relates to a tool, and more particularly to a tool having a rotatable driving head and having a light device attached to the rotatable driving head.

2. Description of the Prior Art

U.S. Pat. No. 5,875,692 to the present applicant discloses a typical ratchet tool. U.S. Pat. No. 5,713,656 to the present applicant discloses a typical tool having a light device. However, when the typical tools include a rotatable driving head, the light device may not be engaged in the driving head due to the rotation engagement of the driving head to the handle.

The present invention has arisen to mitigate and/or obviate the afore-described disadvantages of the conventional tools.

SUMMARY OF THE INVENTION

The primary objective of the present invention is to provide a tool including a light device attached to a rotatable driving head for lighting purposes.

In accordance with one aspect of the invention, there is provided a tool comprising a handle including a chamber for receiving at least one battery, a housing pivotally secured to the handle at a pivot shaft for supporting at least one light bulb, and means for electrically coupling the battery to the light bulb and to energize the light bulb even when the housing is rotated relative to the handle.

The light bulb and the battery each includes a center electrode and a case electrode, the electrically coupling means includes a first conductor and a second conductor coupled to the center electrode and the case electrode of the light bulb, and a third conductor and a four conductor coupled to the center electrode and the case electrode of the battery and electrically coupled to the first and the second conductors respectively. The first and the second conductors each includes a ring rotatably provided around the shaft and electrically coupled to the first and the second conductors for electrically coupling the battery to the light bulb and to energize the light bulb when the housing is rotated relative to the handle. A fifth and a sixth conductors each includes a ring-shape rotatably provided around the shaft and engaged with the rings of the first and the second conductors respectively, and each includes a terminal electrically coupled to the first and the second conductors.

The handle includes a channel and a passage formed therein and communicating with each other, the terminals of the fifth and the sixth conductors are extended through the passage and received in the channel of the handle and electrically coupled to the first and the second conductors. The housing includes a pair of annular recesses formed therein for receiving the rings of the first and the second conductors respectively.

A ratchet mechanism is provided in the housing, and a driving stem is coupled to the ratchet mechanism and to be controlled by the ratchet mechanism. The driving stem is rotatably secured to the housing, the ratchet mechanism includes a first and a second ratchet gears slidably engaged on the driving stem and rotated in concert with the driving stem, a third and a fourth ratchet gears rotatably and slidably engaged on the driving stem and slidably engaged in the housing and rotated in concert with the housing, and means for biasing the third and the fourth ratchet gears to engage with the first and the second ratchet gears respectively, and means for selectively disengaging the third and the fourth ratchet gears from the first and the second ratchet gears to control a driving direction of the driving stem.

A cartridge is secured in the housing and has at least one channel formed therein, a barrel is rotatably engaged on the driving stem and rotatably received in the cartridge, the third and the fourth ratchet gears each includes a projection slidably engaged in the channel of the cartridge for slidable in the cartridge and for rotating in concert with the cartridge.

The selectively disengaging means includes a ferrule secured to the barrel and having at least one extension engaged with the projection of the third ratchet gear for disengaging the third ratchet gear from the first ratchet gear, and includes at least one actuating surface provided in the barrel for engaging with the projection of the fourth ratchet gear to disengage the fourth ratchet gear from the second ratchet gear.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
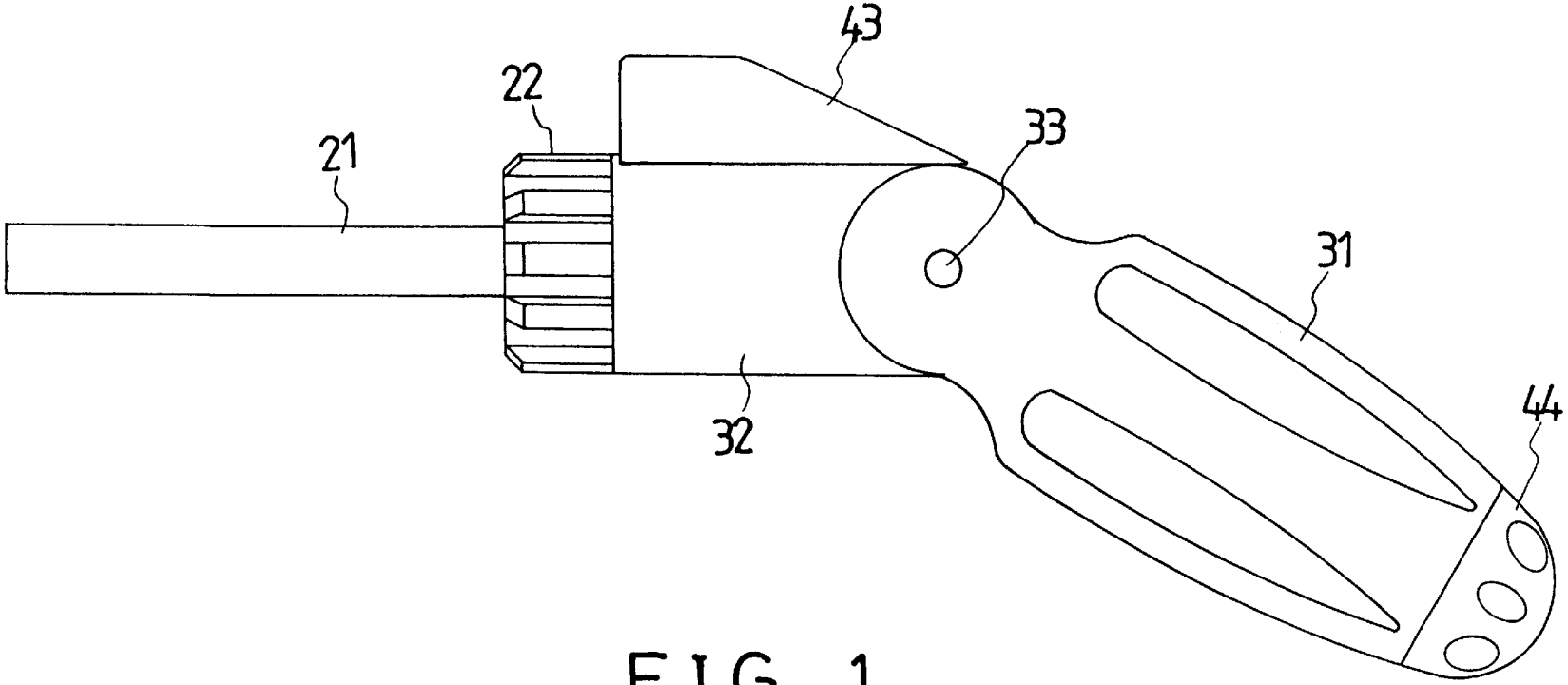
FIG. 1 is a plane view of a tool in accordance with the present invention.

Referring to the drawings, and initially to FIGS. 1–4, a tool in accordance with the present invention comprises a handle 31 pivotally coupled to a housing 32 at a pivot shaft 33. The handle 31 includes a chamber 310 formed therein for receiving a casing 40 and includes a slot 313 formed in one end and defined by a pair of panels 311, 312 for rotatably receiving an ear 321 extended from the front end of the handle 31. The shaft 33 is engaged through the holes 34 of the panels 311, 312 and engaged through a hole 35 of the ear 321 of the handle 31 for pivotally securing the housing 32 to the handle 31. The handle 31 includes a passage 35 formed between the slot 313 and the chamber 310 thereof, and includes a channel 316 communicating with the passage 35, and includes an inner thread 314 formed in the rear end thereof. A pair of ring-shaped conductors 61, 62 are received in the slot 313 of the handle 31 and provided around the shaft 33 and each includes a terminal 611, 621 extended inward of the channel 316 via the passage 315 of the handle 31.

Figure 4:
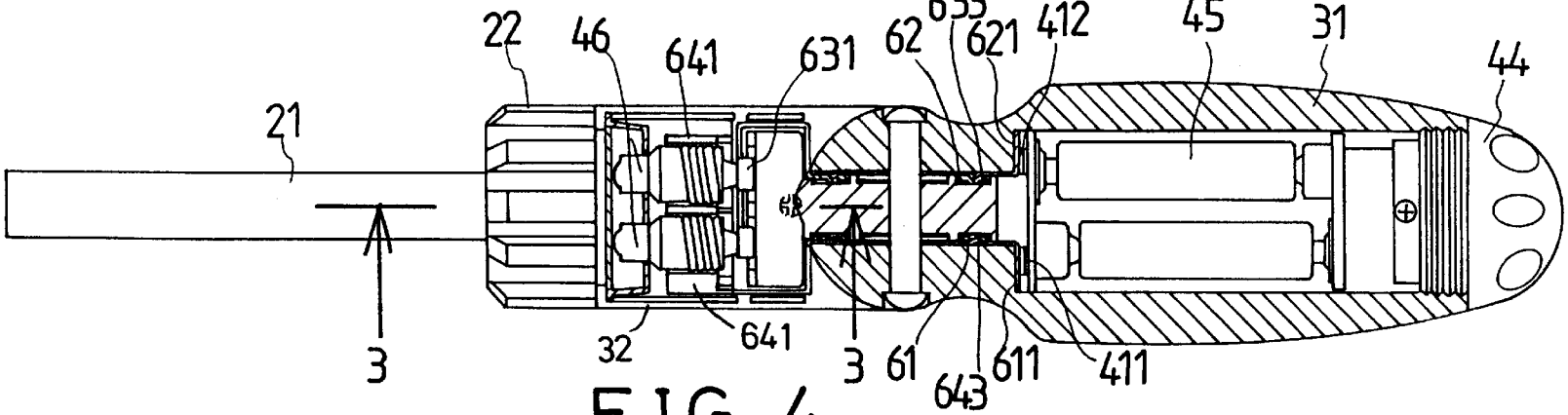
FIG. 4 is a cross sectional view taken along lines 4—4 of FIG. 3.

The casing 40 includes one or more spaces 41 formed therein for receiving batteries 45 which may be coupled together in series or in parallel to each other by a conductor 49, and includes two conductors 411, 412 coupled to the case electrode and the center electrode of the batteries 45 and engaged with the terminals 611, 621 of the conductors 61, 62 (FIG. 4). The casing 40 includes a cap 44 having an outer thread 441 for threading with the inner thread 314 of the handle 31 and for securing the casing 40 to the handle 31, and includes a switch 442 for controlling the electric circuit between the conductors 411, 412. The actuation of the switch 442 to the electric circuit has been widely used nowadays. The housing 32 includes one or more depressions 42 formed therein for receiving one or more light bulbs 46 and includes a chamber 322 formed therein for receiving a driving cartridge 23 therein, and includes a box or a reflector 47 disposed on top for partially receiving the light bulbs 46. A cap 43 is secured to the housing 32 for retaining the light bulbs 46 and/or the reflector 47 in place. A transparent lid 48 may be attached to the front portion of the reflector 47 for enclosing the light bulbs 46.

A pair of conductors 63, 64 are disposed in the cap 43 and each includes a ring 633, 643 provided on one end and provided around the shaft 33 and engaged with the ring-shaped conductors 62, 61 respectively. One of the conductors 63 includes a terminal 631 coupled to the center electrode(s) of the light bulb(s) 46 (FIG. 3), and the other conductor 64 has a terminal 641 coupled to the case electrode(s) of the light bulb(S) 46. The conductors 63, 64 and 62, 61 may be continuously and electrically contacted with each other when the housing 32 is rotated relative to the handle 31 about the pivot shaft 33 due to the ring-shaped configuration of the conductors, such that the light bulbs 46 may be electrically coupled to the batteries 45 and may be controlled by the switch 442. It is preferably that the housing 32 includes a pair of annular recesses 323 formed in the ear 321 of the housing 32 for stably and rotatably receiving the ringshaped conductors 61, 62 and the rings 633, 643 of the conductors 63, 64.

Figure 2:
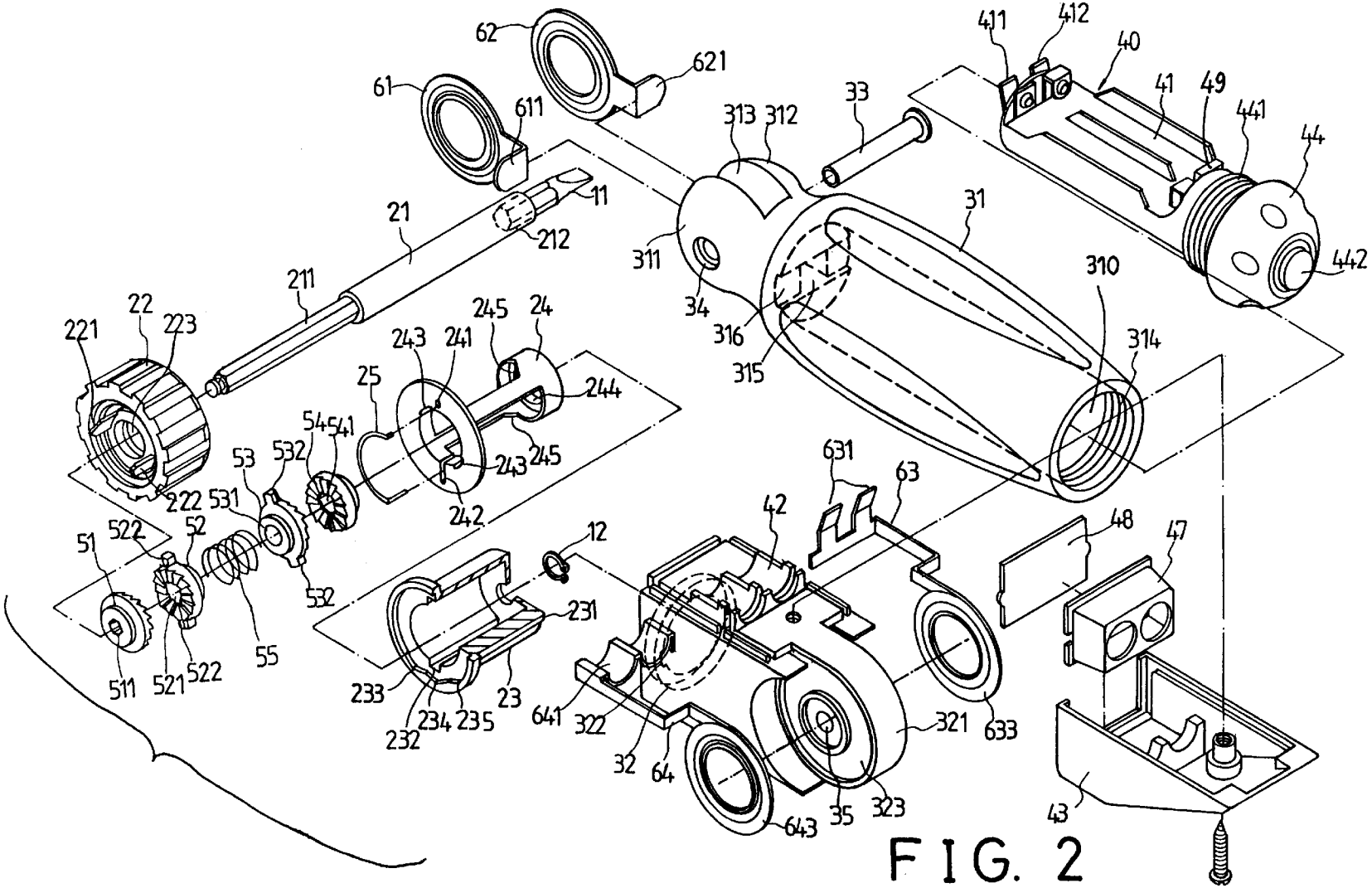
FIG. 2 is an exploded view of the tool.
Figure 3:
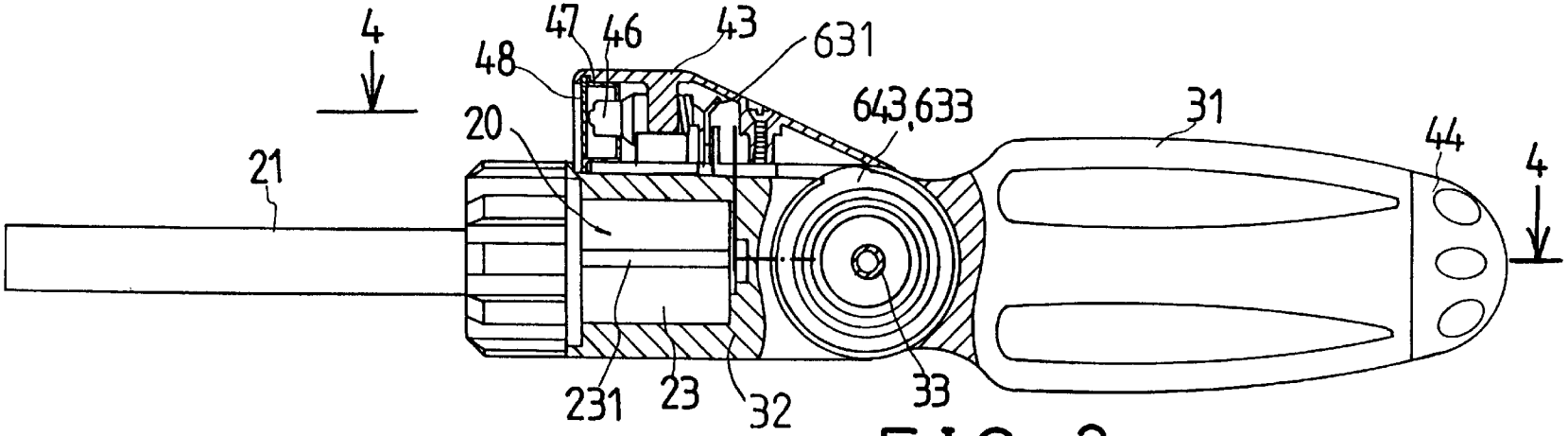
FIG. 3 is a partial cross sectional view taken along lines 3—3 of FIG. 4.
Figure 5:
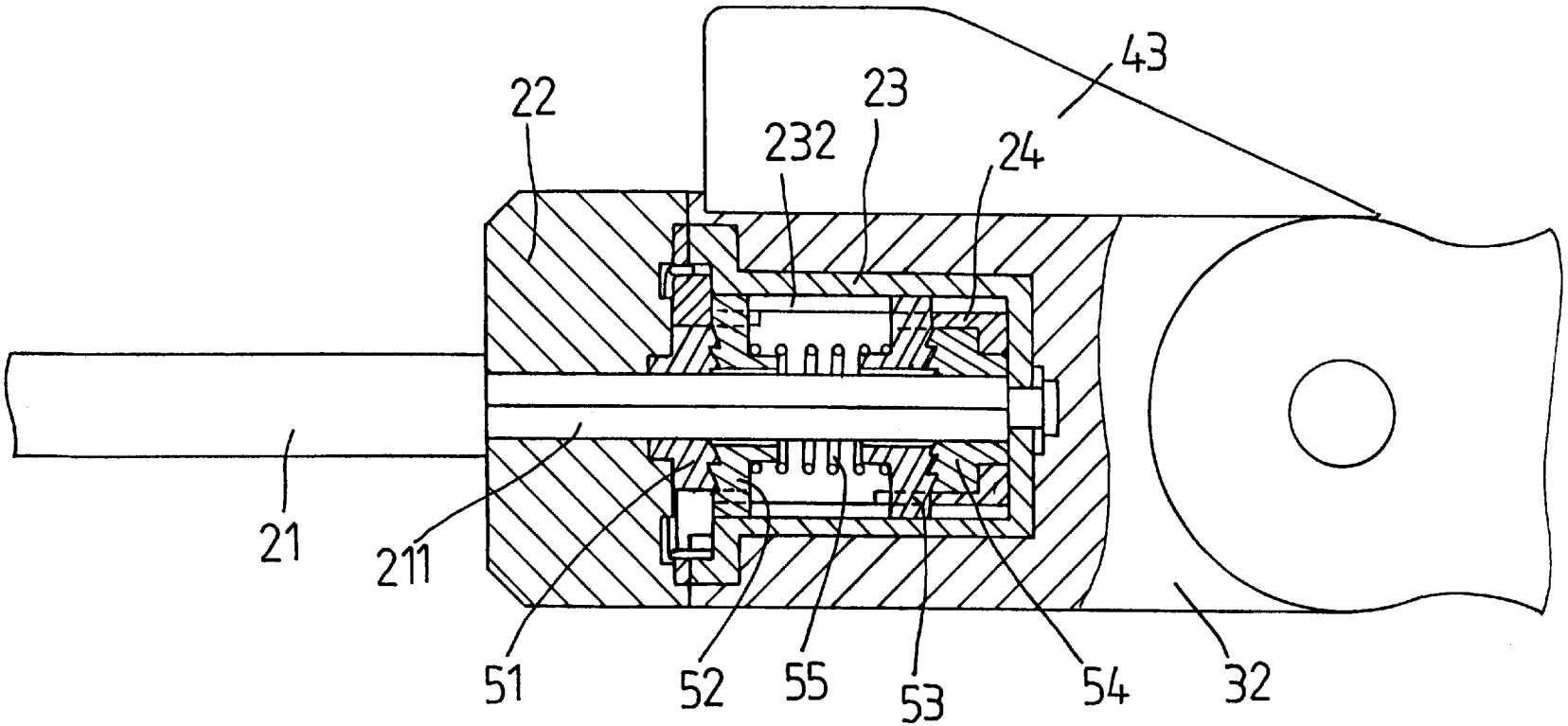
FIG. 5 is a partial cross sectional view taken along lines 3—3 of FIG. 4.

Referring next to FIG. 5 and again to FIG. 2, the cartridge 23 includes one or more keys 231 engaged with the grooves 322 of the housing 32 such that the housing 32 rotates in concert with the cartridge 23, and includes one or more channels 232 formed therein. A barrel 24 is received in the cartridge 23 and includes a pair of notches 244 formed therein. A driving stem 21 includes one end 211 engaged through the barrel 24 and the cartridge 23 and is rotatably secured to the cartridge 23 with a clamping ring 12, and includes an engaging hole 212 formed in the other end for receiving the tool bit 11. Two ratchet gears 51, 54 each includes a non-circular hole 511, 541 formed therein and engaged with the one end 211 of the driving stem 21 of the corresponding non-circular cross section such that the ratchet gears 51, 54 are rotated in concert with the driving stem 21. Two further ratchet gears 52, 53 each includes a circular hole 521, 531 rotatably engaged on the driving stem 21 and each includes one or more projections 522, 532 extended through the notches 244 of the barrel 24 and slidably engaged in the channels 232 of the cartridge 23. A spring 55 is engaged between the ratchet gears 52, 53 to bias the gears 52, 53 to engage with the other gears 51, 54 respectively.

A control ferrule 22 includes a bore 223 rotatably receiving the driving stem 21 and includes one or more extensions 221, 222 extended through one or more cavities 243 of the barrel 24 and engageable with the projections 522 of the gear 52 for disengaging the gear 52 from the gear 51 when the ferrule 22 is rotated relative to the cartridge 23. The barrel 24 includes one or more actuating tapered surfaces 245 (FIG. 2) for engaging with the projections 532 of the gear 53 to disengage the gear 53 from the gear 54 when the barrel 24 is rotated relative to the cartridge 23 by the ferrule 22. A spring 25 has one end engaged into a hole 241 of the barrel 24 and has the other end slidably engaged in a slit 242 of the barrel 24 and engaged with either of three recesses 233, 234, 235 of the cartridge 23 for positioning the barrel 24 to the cartridge 23. One example of the ratchet mechanism is disclosed in the applicant's prior U.S. Pat. No. 5,875,692 which is taken as a reference for the present invention. The cartridge 23 may receive the other type of ratchet mechanism for controlling the operation directions of the driving stem 21.

When either of the gears 52, 53 is disengaged from the respective gears 51, 54, the driving stem 21 may be driven by the housing 32 and the handle 31 in one driving direction only. When both the gears 52, 53 are biased to engage with the respective gears 51, 54, the driving stem 21 may be driven by the housing 32 and the handle 31 in both of the driving directions.

Figure 6:
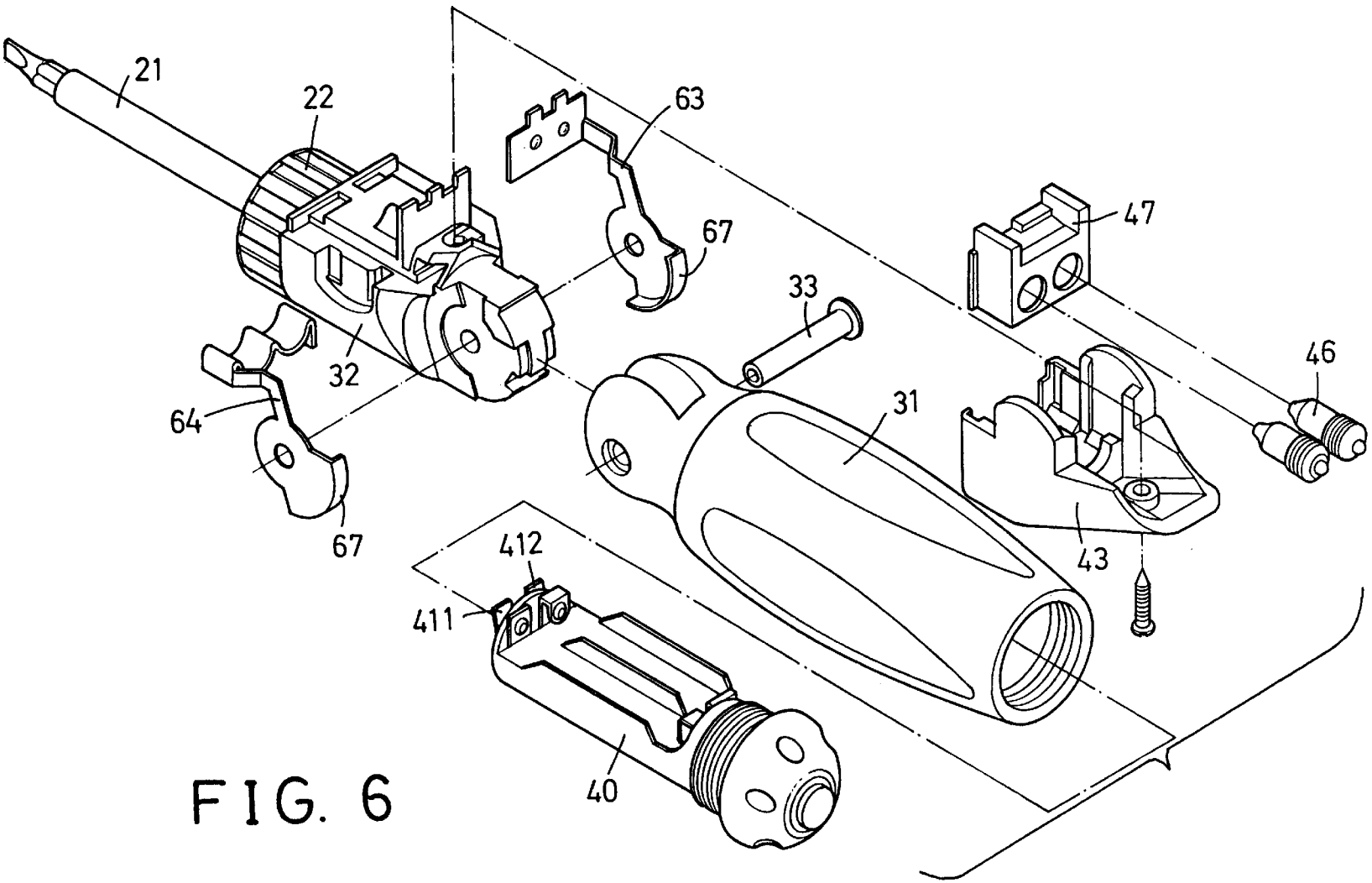
FIG. 6 is an exploded view illustrating another application of the tool.
Figure 7:
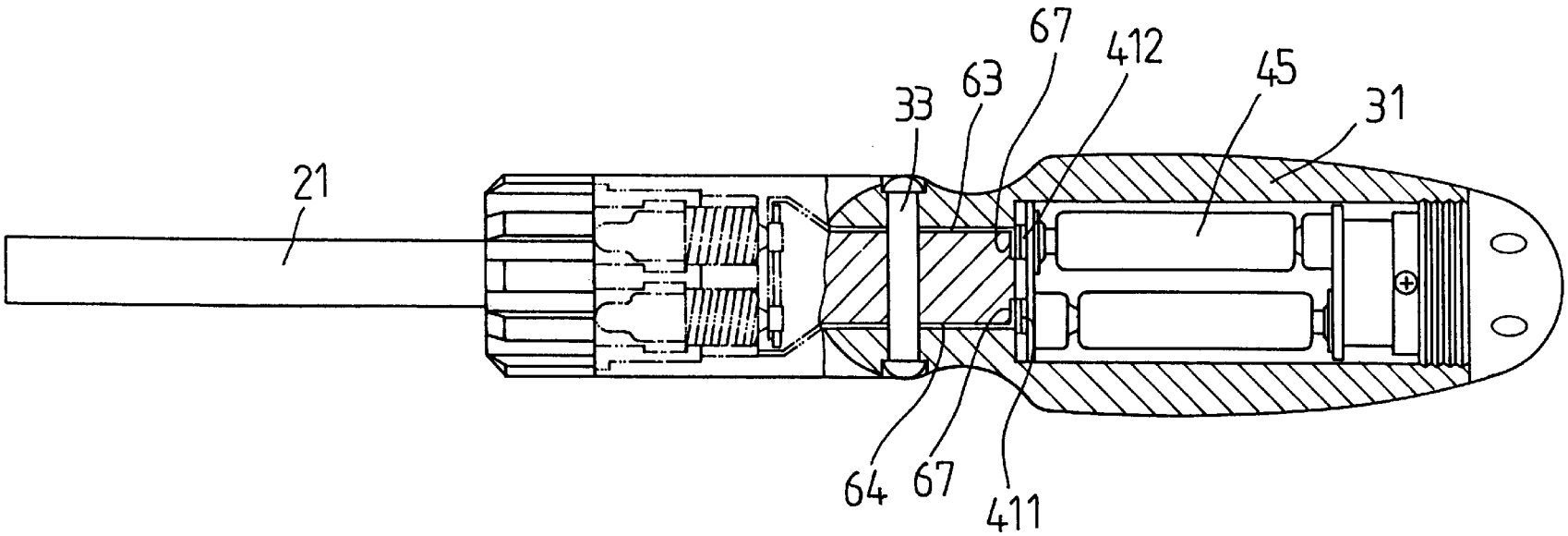
FIG. 7 is a cross sectional view of the tool as shown in FIG. 6.

As shown in FIGS. 6 and 7, the conductors 63, 64 may each include a curved terminal 67 for slidably engaging with the conductors 411, 412 such that the conductors 63, 64 may also be coupled to the conductors 411, 412, without the conductors 61, 62, when the housing 32 is rotated relative to the handle 31.

Accordingly, the tool in accordance with the present invention includes a light device attached to a rotatable driving head for lighting purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a handle including a chamber formed therein, at least one battery received in said chamber of said handle, a housing pivotally secured to said handle at a pivot shaft, at least one light bulb secured on said housing, and means for electrically coupling said at least one battery to said at least one light bulb and to energize said at least one light bulb, said at least one light bulb being energizeable by said at least one battery when said housing is rotated relative to said handle, wherein said at least one light bulb and said at least one battery each includes a center electrode and a case electrode, said electrically coupling means includes a first conductor and a second conductor coupled to said center electrode and said case electrode of said at least one light bulb, and a third conductor and a four conductor coupled to said center electrode and said case electrode of said at least one battery and electrically coupled to said first and said second conductors respectively.

2. The tool according to claim 1, wherein said first and said second conductors each includes a ring rotatably provided around said shaft and electrically coupled to said first and said second conductors for electrically coupling said at least one battery to said at least one light bulb and to energize said at least one light bulb when said housing is rotated relative to said handle.

3. The tool according to claim 2, further comprising a fifth and a sixth conductors each including a ring-shape rotatably provided around said shaft and engaged with said rings of said first and said second conductors respectively, and each including a terminal electrically coupled to said first and said second conductors.

4. The tool according to claim 3, wherein said handle includes a channel and a passage formed therein and communicating with each other, said terminals of said fifth and said sixth conductors are extended through said passage and received in said channel of said handle and electrically coupled to said first and said second conductors.

5. The tool according to claim 2, wherein said housing includes a pair of annular recesses formed therein for receiving said rings of said first and said second conductors respectively.

6. A tool comprising:

a handle including a chamber formed therein, at least one battery received in said chamber of said handle, a housing pivotally secured to said handle at a pivot shaft, at least one light bulb secured on said housing, means for electrically coupling said at least one battery to said at least one light bulb and to energize said at least one light bulb, said at least one light bulb being energizeable by said at least one battery when said housing is rotated relative to said handle, a ratchet mechanism provided in said housing, and a driving stem coupled to said ratchet mechanism and to be controlled by said ratchet mechanism.

7. The tool according to claim 6, wherein said driving stem is rotatably secured to said housing, said ratchet mechanism includes a first and a second ratchet gears slidably engaged on said driving stem and rotated in concert with said driving stem, a third and a fourth ratchet gears rotatably and slidably engaged on said driving stem and slidably engaged in said housing and rotated in concert with said housing, and means for biasing said third and said fourth ratchet gears to engage with said first and said second ratchet gears respectively, and means for selectively disengaging said third and said fourth ratchet gears from said first and said second ratchet gears to control a driving direction of said driving stem.

8. The tool according to claim 7, further comprising a cartridge secured in said housing and including at least one channel formed therein, a barrel rotatably engaged on said driving stem and rotatably received in said cartridge, said third and said fourth ratchet gears each including a projection slidably engaged in said at least one channel of said cartridge for slidable in said cartridge and for rotating in concert with said cartridge.

9. The tool according to claim 8, wherein said selectively disengaging means includes a ferrule secured to said barrel and having at least one extension extended therefrom and engaged with said projection of said third ratchet gear for disengaging said third ratchet gear from said first ratchet gear, and includes at least one actuating surface provided in said barrel for engaging with said projection of said fourth ratchet gear and for disengaging said fourth ratchet gear from said second ratchet gear.

* * * * *